US006364192B1

(12) United States Patent
Lin

(10) Patent No.: US 6,364,192 B1
(45) Date of Patent: Apr. 2, 2002

(54) DEVICE FOR PREVENTING ACTION ROD OF NAILER FROM DESCENDING

(76) Inventor: Wang-Kuan Lin, 11F-2, No. 43, Chai-I Street, Taichung City (TW)

( * ) Notice: Subject to any disclaimer, the term of this patent is extended or adjusted under 35 U.S.C. 154(b) by 0 days.

(21) Appl. No.: 09/907,615

(22) Filed: Jul. 19, 2001

(51) Int. Cl.[7] ..... B25C 1/04
(52) U.S. Cl. ..... 227/113; 227/130
(58) Field of Search ..... 227/119, 113, 227/156, 130

(56) References Cited

U.S. PATENT DOCUMENTS 3,438,449 A * 4/1969 Smith ..... 227/130
3,813,993 A * 6/1974 Smith ..... 91/220
5,074,453 A * 12/1991 Tachihara et al. ..... 227/130
6,095,394 A * 8/2000 Wang-Kuan ..... 227/130
6,138,888 A * 10/2000 Liao ..... 227/130
6,193,127 B1 * 2/2001 Huang ..... 227/130

* cited by examiner

*Primary Examiner*—Scott A. Smith
(74) *Attorney, Agent, or Firm*—Charles E. Baxley

(57) ABSTRACT

A nailer includes a casing and a piston rod extends through a neck of the casing. A sleeve is connected to the neck and a passage is defined longitudinally through the sleeve so that the piston rod is movably inserted into the passage. A slot is defined through a wall of the sleeve and communicates with the passage. An action rod is inserted in the passage and a hole is defined through the action rod. A pin extends through the slot and the hole. A spring has an end contacting the first end of the action rod and the other end of the spring contacts a flange extending from an inside of the neck. The action rod will not descend when the nailer is put upside-down.

2 Claims, 5 Drawing Sheets

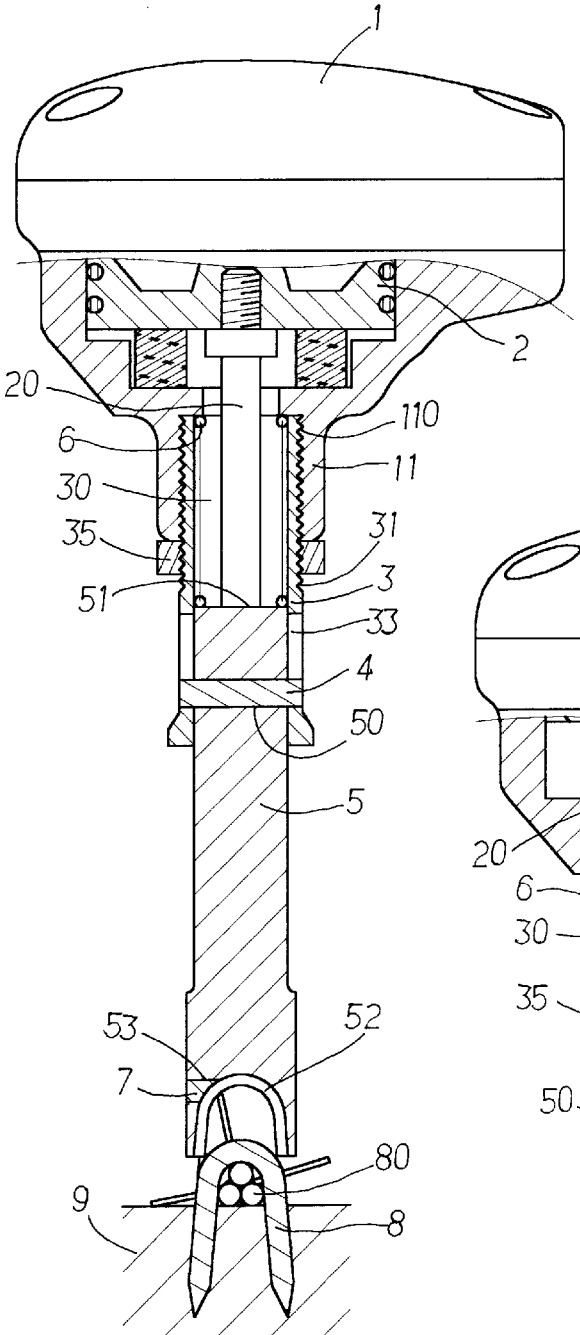
FIG·4
FIG·3
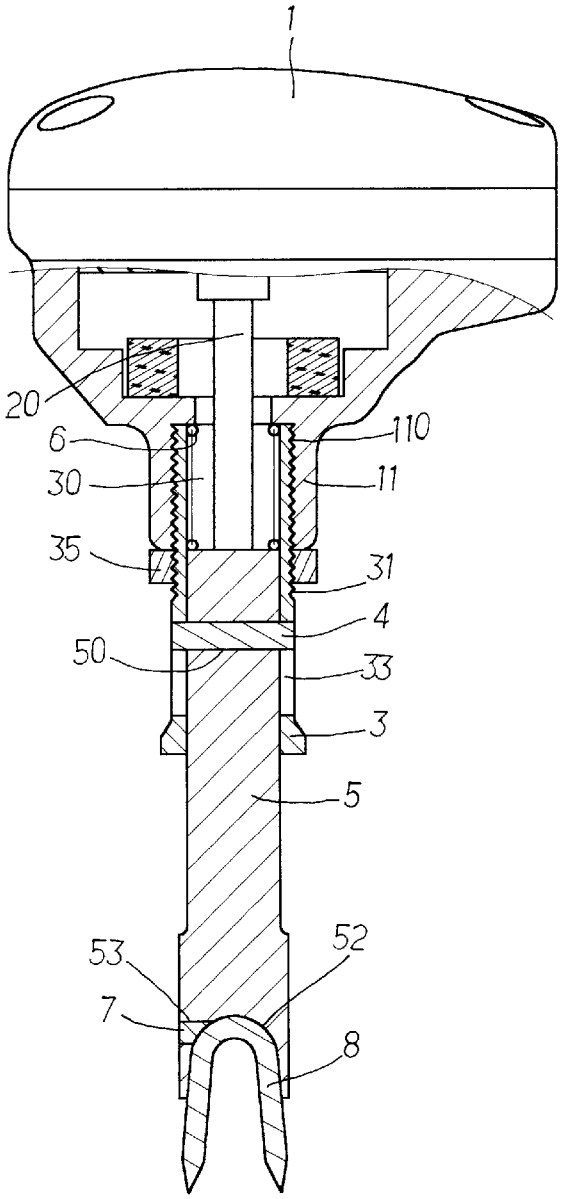

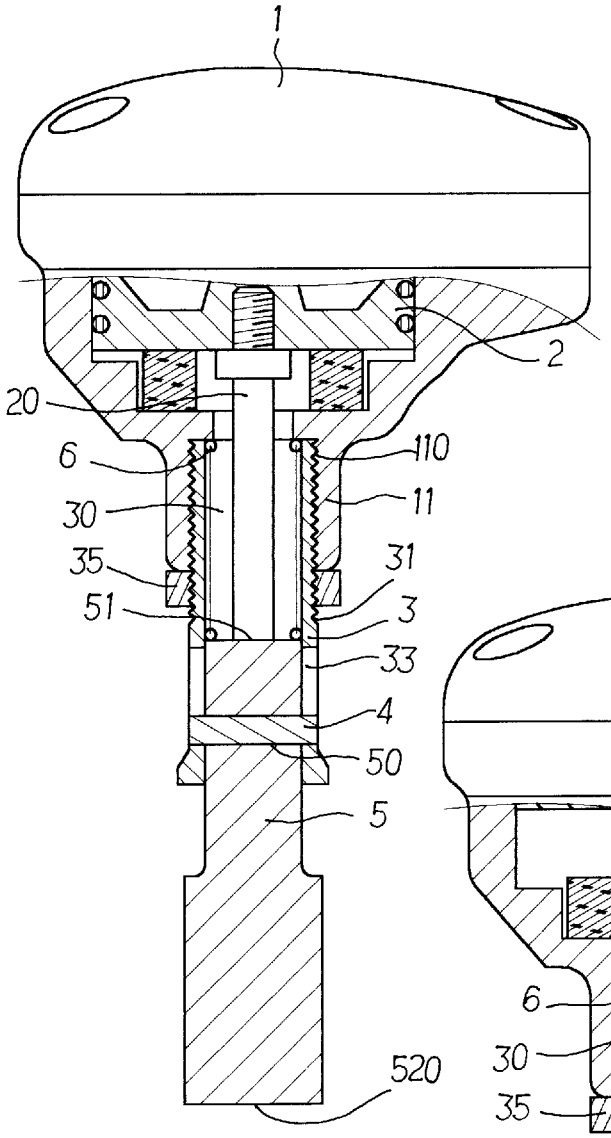
FIG. 5
FIG. 6
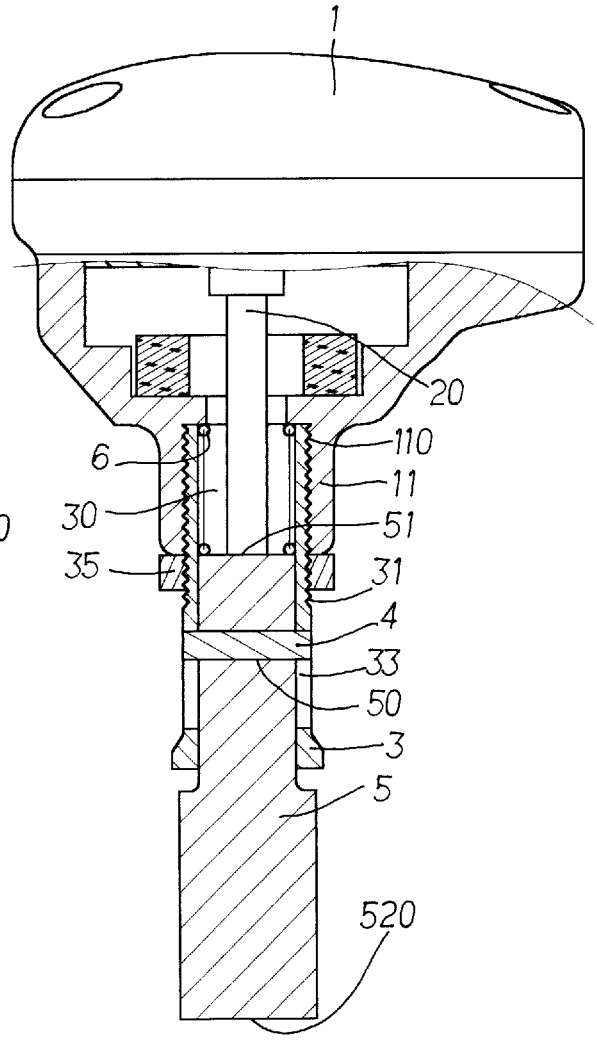

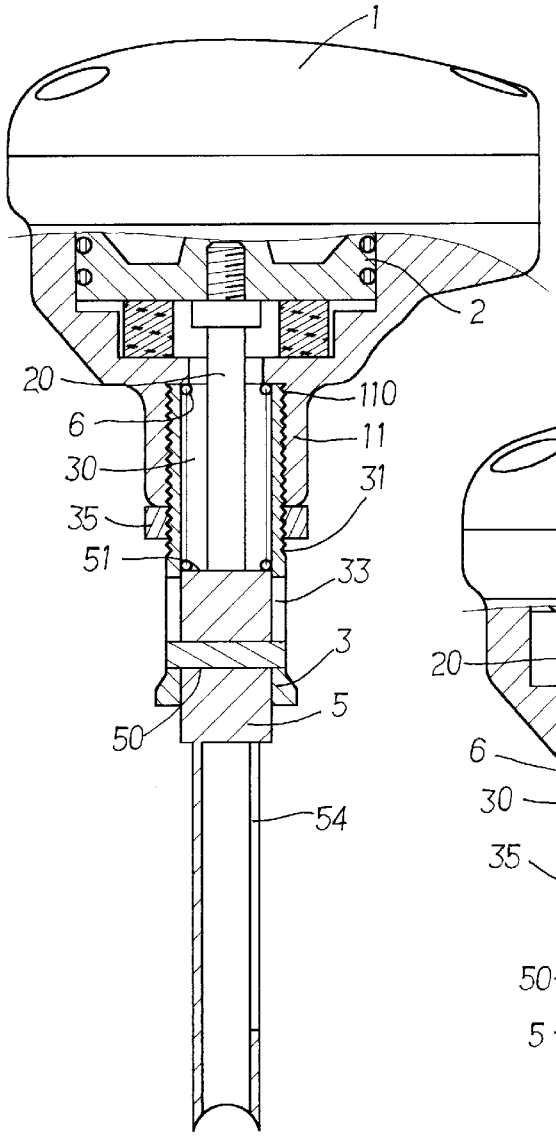
FIG. 7
FIG. 8
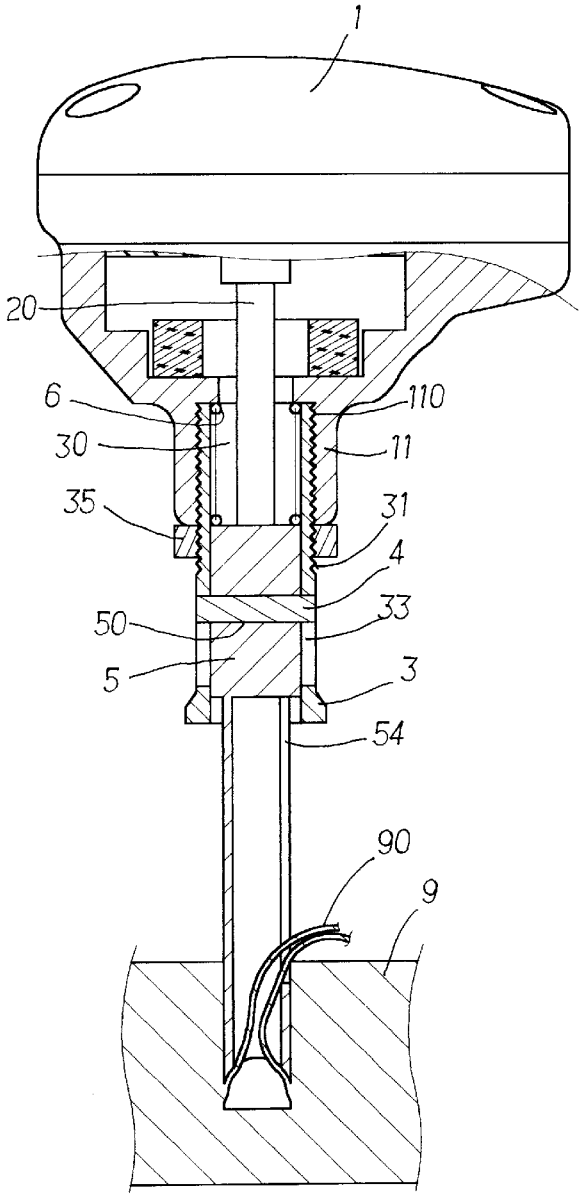

DEVICE FOR PREVENTING ACTION ROD OF NAILER FROM DESCENDING

FIELD OF THE INVENTION

The present invention relates to a power nailer having a spring biased between a top of an action rod and an inside of a recess of the nailer. The spring prevents the action rod from descending to touch other parts when the nailer is put upside-down.

BACKGROUND OF THE INVENTION

A conventional is shown in FIG. 1 and generally includes casing 1 having an air inlet 10 and a neck 11 in which a piston rod 20 is movably inserted. A sleeve 3 having outer threads 31 is threadedly engaged with the neck 11 and a passage 30 is defined longitudinally through the sleeve 3 so that the piston rod 20 extends in the passage 30. A slot 33 defined transversely through the sleeve 3 and an action rod 4 is inserted in the passage 30 in the sleeve 3 from a lower end of the sleeve 3. A bolt 5 is inserted in the slot 33 and engaged with a hole 40 in the action rod 4 so that the action rod 4 is movable within a range of the slot 33. A tool 6 is inserted in a grove 42 defined in the lower end of the action rod 4 and is fixedly positioned by extending a bolt 45 through a hole 410 in the action rod 4 and engaged with holes 60 in the tool 6.

When the nailer is put upside-down, the action rod 4 descends because of the gravity and the movement of the action rod 4 will result the descent of the piston rod 20 which could activate an automatic operation mold without notice of the users. This could lead to a dangerous situation.

SUMMARY OF THE INVENTION

In accordance with one aspect of the present invention, there is provided a nailer which comprises a casing having an air inlet and a neck. A piston device is movably received in the casing and a piston rod extends through the neck. A sleeve is engaged with the neck and a passage is defined longitudinally through the sleeve for the piston rod movably received therein. A slot is defined through a wall of the sleeve and communicates with the passage. An action rod has a first end thereof inserted in the passage from a lower end of the sleeve and a hole is defined through the action rod. A pin extends through the slot and the hole. A spring has an end contacting the first end of the action rod and the other end of the spring contacts a flange extending from an inside of the neck.

The primary object of the present invention is to provide a nailer wherein the action rod will not descend to touch other parts in the casing when the nailer is put upside-down.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 3 is a cross sectional view to show the nailer of the present invention;

FIG. 4 is a cross sectional view to show the nailer of the present invention, wherein the action rod is extended to nail on a wood board;

FIG. 5 is a cross sectional view to show another embodiment of the nailer of the present invention, wherein the action rod is extended;

FIG. 6 is a cross sectional view to show the embodiment in FIG. 5 of the present invention, wherein the action rod is pulled back;

FIG. 7 is a cross sectional view to show yet another embodiment of the nailer of the present invention, wherein a chisel is connected to the action rod, and FIG. 8 is a cross sectional view to show the embodiment in FIG. 7 to chisel a wood board.

DETAILED DESCRIPTION OF THE PREFERRED EMBODIMENTS

Figure 1:
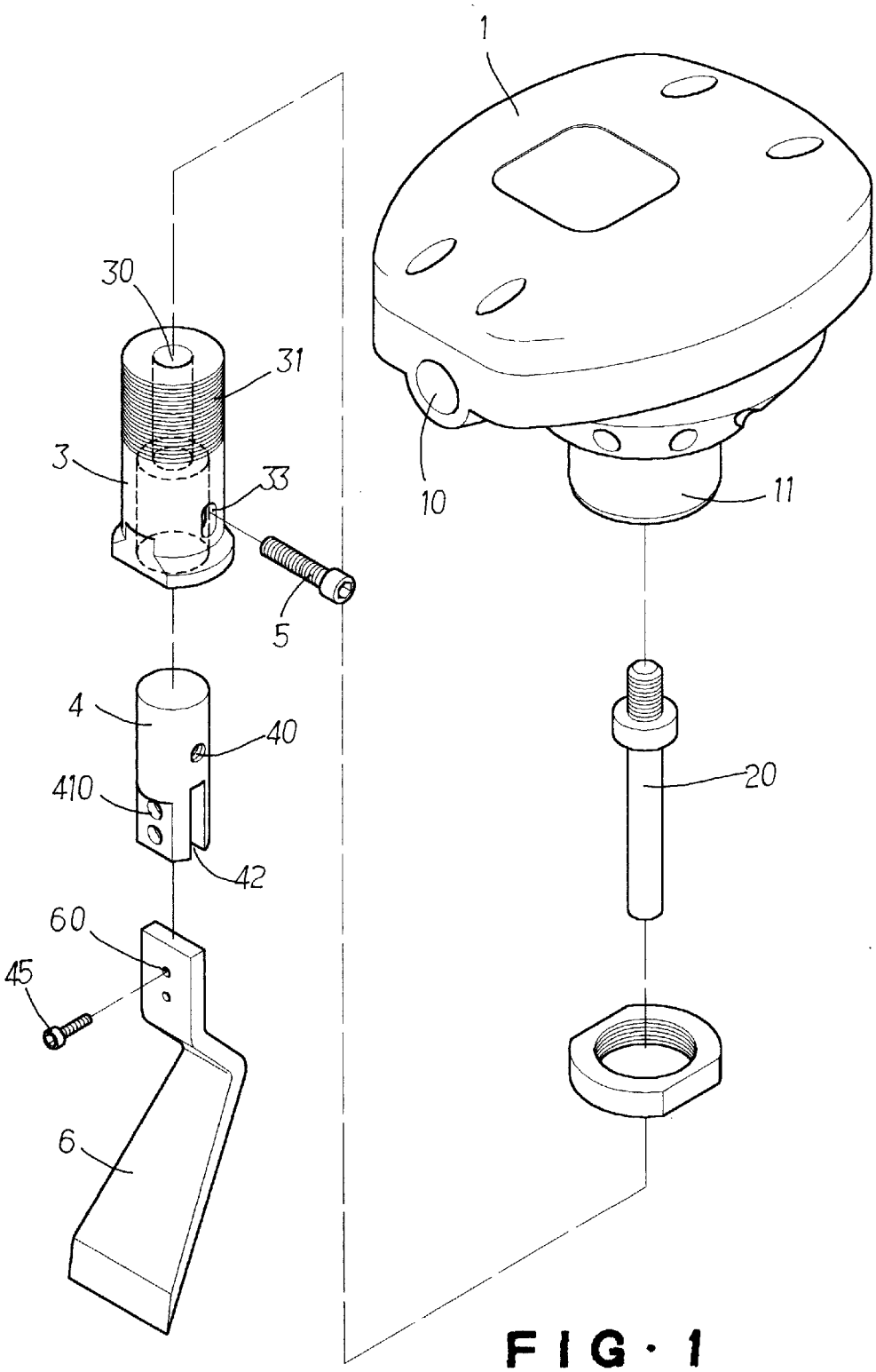
FIG. 1 PRIOR ART
FIG. 1 is an exploded view to show a conventional nailer.
Figure 2:
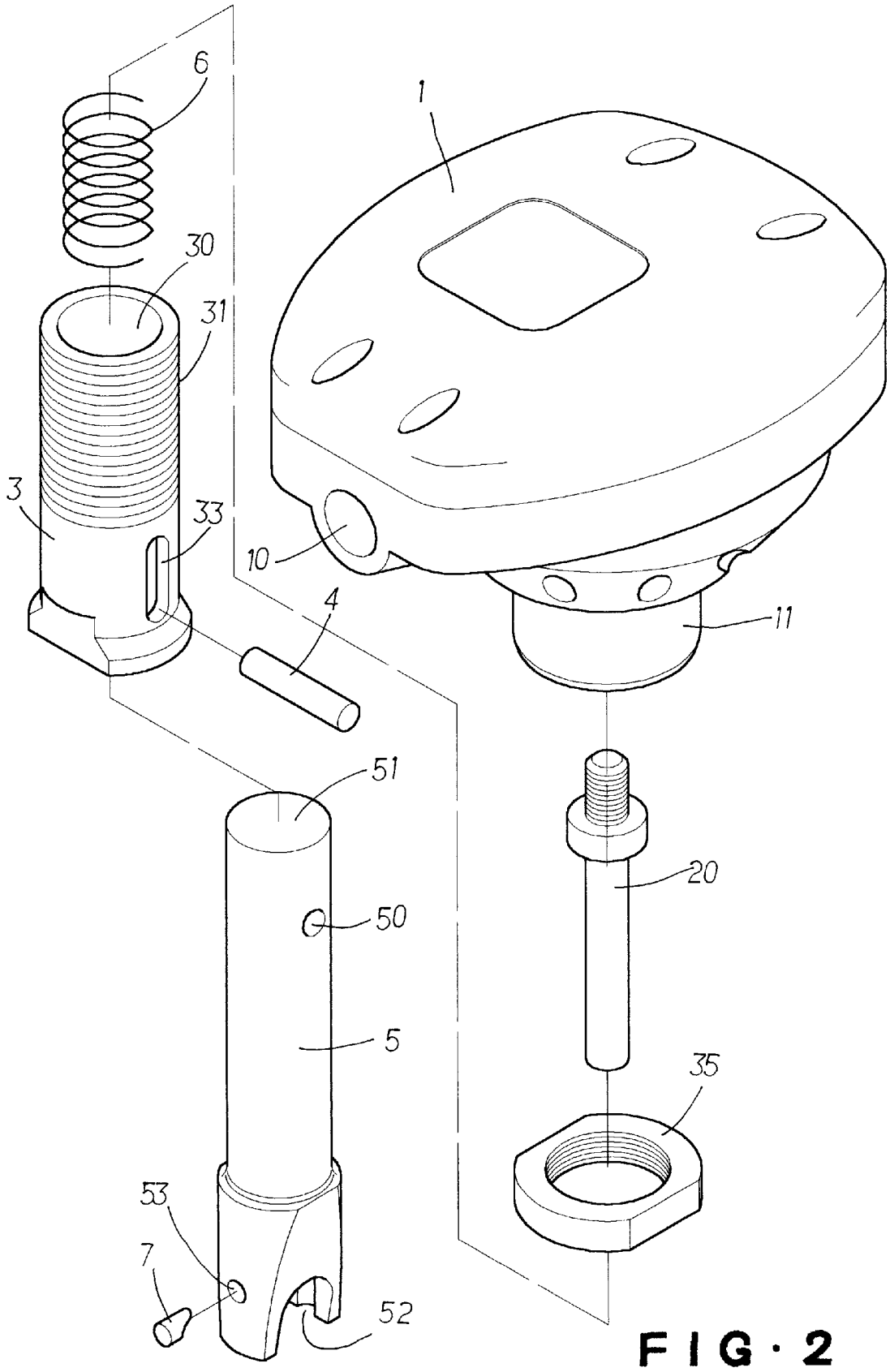
FIG. 2 is an exploded view to show a nailer of the present invention.

Referring to FIGS. 2 and 3, the power nailer of the present invention comprises a casing 1 having an air inlet 10 and a neck 11, wherein a piston device 2 movably received in the casing 1 and a piston rod 20 extends through the neck 11. A sleeve 3 has threads 31 defined in an outer periphery thereof and the threads 31 are engaged with an inner threads 110 in the neck 11. A passage 30 is defined longitudinally through the sleeve 3 so that the piston rod 20 is movably inserted in the passage 30. A nut 35 is mounted to the sleeve 3 and threadedly engaged with the threads 31 to secure the sleeve 3 to the neck 11. A slot 33 is defined through a wall of the sleeve 3 and communicates with the passage 30.

An action rod 5 has a first end thereof inserted in the passage 30 from a lower end of the sleeve 3 and a hole 50 is defined through the action rod 5. A pin 4 extends through the slot and the hole 50 so that the action rod 5 is able to be moved within the range of the slot 33. A recess 52 is defined in a second end of the action rod 5 and a receiving hole 53 is defined through the second end of the action rod 5 and communicates with the recess 52. A magnet 7 is engaged with the receiving hole 53 so as to adhere a nail 8 in the recess 52 in the second end of the action rod 5.

A spring 6 is received in the passage 30 and has an end contacting the first end 51 of the action rod 5 and the other end of the spring 6 contacts a flange extending from an inside of the neck 11.

As shown in FIG. 4 when activating the nailer, the action rod 5 is extended and the nail 8 penetrates a wood board 9 and wires 80 are restrained between the nail 8 and the board 9.

FIGS. 5 and 6 show that the second end of the action rod 5 is a flat surface 52 and the action rod 5 are used as a power hammer.

FIGS. 7 and 8 show that the second end of the action rod 5 is connected to a chisel 54 which has a groove so that the debris 90 of the wood board 9 is easily removed from the board 9.

When the power nailer is put upside-down, the action rod 5 is held by the spring 6 so that it will not descend to touch any control parts in the casing 1 so as to prevent unintentional activations.

While we have shown and described the embodiment in accordance with the present invention, it should be clear to those skilled in the art that further embodiments may be made without departing from the scope of the present invention.

What is claimed is:

1. A nailer comprising:

a casing having an air inlet and a neck, a piston device movably received in said casing and a piston rod extending through said neck;

a sleeve engaged with said neck and a passage defined longitudinally through said sleeve, said piston rod movably inserted in said passage, a slot defined through a wall of said sleeve and communicating with said passage;

an action rod having a first end thereof inserted in said passage from a lower end of said sleeve and a hole defined through said action rod, a pin extending through said slot and said hole, and a spring having an end contacting said first end of said action rod and the other end of said spring contacting a flange extending from an inside of said neck.

2. The nailer as claimed in claim 1 further comprising a recess defined in a second end of said action rod and a magnet connected to said second end of said action rod.

* * * * *